United States Patent [19]

Extra et al.

[11] 4,265,997

[45] May 5, 1981

[54] AUTOMATIC TONER CONTROL

[75] Inventors: Piet M. J. Extra, Tegelen; Taco H. J. van den Honert, Venlo; Jacobus J. van Lieshout, Grubbenvorst, all of Netherlands

[73] Assignee: Océ-Nederland B.V., Venlo, Netherlands

[21] Appl. No.: 65,323

[22] Filed: Aug. 9, 1979

[30] Foreign Application Priority Data

Aug. 14, 1978 [NL] Netherlands ..... 7808419

[51] Int. Cl.[3] ..... G03G 15/08

[52] U.S. Cl. ..... 430/122; 430/120; 118/691; 118/712; 118/657

[58] Field of Search ..... 118/691, 690, 689, 712, 118/657; 430/120, 122; 355/3 DD

[56] References Cited

U.S. PATENT DOCUMENTS

| | | | |
|---|---|---|---|
| 3,567,923 | 3/1971 | Hutchison | 101/202 X |
| 4,064,833 | 12/1977 | Gluck et al. | 118/691 |
| 4,081,571 | 3/1978 | Nishihama et al. | 355/3 DD X |
| 4,112,870 | 9/1978 | Extra et al. | 118/657 |

*Primary Examiner*—Mayer Weinblatt
*Assistant Examiner*—John L. Goodrow
*Attorney, Agent, or Firm*—Albert C. Johnston

[57] ABSTRACT

In a system for developing electrostatic images on a moving photoconductive support by contact with a brush of two-component developer powder carried on a moving surface, in which the toner content of the powder is controlled in response to optical sensings of the reflectance of the brush at a location just beyond the developing zone, objectionable fluctuations of the toner concentration are avoided by shaping the developer brush to a constant layer thickness, for instance by reducing its thickness to about 0.5 to 0.6 mm, as the brush is being transported from the developing zone so that the sensings of the reflectance will occur at a constant distance from the brush. As an aid for adjusting or checking the operation of the toner control system, a reference surface having the same reflectance as a developer layer of the prescribed thickness and toner concentration is inserted in place of the brush at the location where reflectance is sensed.

12 Claims, 3 Drawing Figures

AUTOMATIC TONER CONTROL

This invention relates to an apparatus and process for measuring and controlling the concentration of toner particles in a two-component developer powder for developing electrostatic latent images.

A technique for controlling the toner concentration is disclosed in Dutch patent application No. 7604400, of which an equivalent has become U.S. Pat. No. 4,112,870. According to that disclosure, the concentration of toner particles present in a magnetically formed brush of a two-component developer powder is sensed optically at a location just behind the developing zone of an apparatus for developing electrostatic latent images on a moving support, such as an endless photoconductive belt. In the practical use of that technique, it has been found that objectionable fluctuations of the toner concentration still occur, with adverse effects on the quality of the image development.

The object of the present invention is to improve the toner concentration control system in such a way that any fluctuations occuring in the toner concentration can be prevented from exceeding the acceptable tolerances.

It has been found that this object can be achieved by providing the toner concentration control system with means which will keep the thickness of the developer brush constant at the place where this brush passes the concentration sensor.

According to the invention in another aspect, adjustments of the concentration control system can be effected in a simple manner by exposing to the light beam of the concentration sensor, at a distance from the sensor corresponding to that which exists when the developer brush moves past the sensor with a certain thickness, a reference surface having the same coefficient of reflection, or light reflectance, as that which the developer brush exhibits at the same distance when it contains toner particles in the desired concentration relative to carrier particles.

The invention will be further understood from the following description and the accompanying drawing of an illustrative embodiment. In the drawing.

Figure 1:
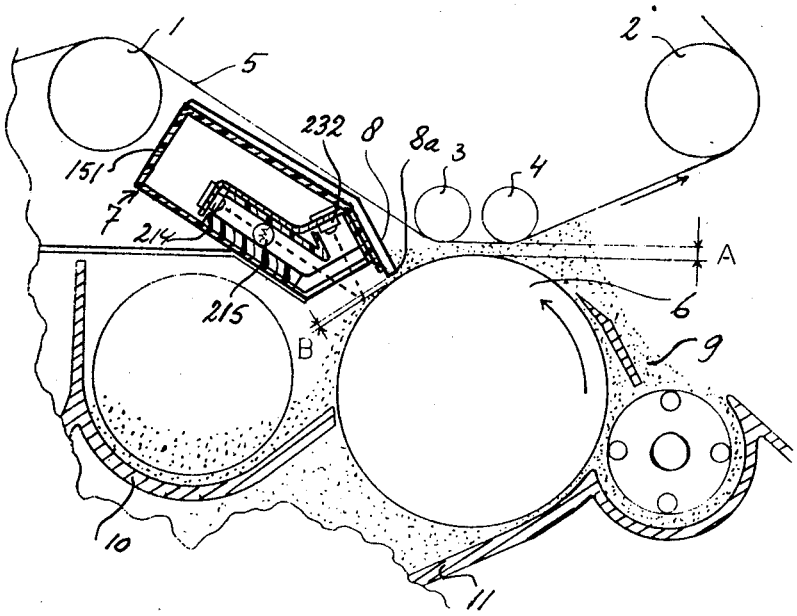
FIG. 1 is a schematic cross sectional view of parts of an apparatus utilizing the invention for the development of electrostatic latent images formed on an endless photoconductive belt.
Figure 2:
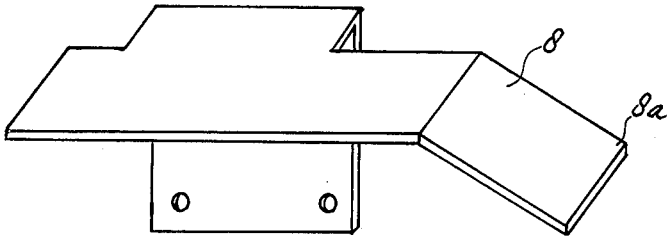
FIG. 2 is a perspective view of a brush thickness control element employed in the apparatus.

A developing apparatus of the type of which certain parts are shown in FIG. 1 is illustrated and described fully in the above-mentioned U.S. Pat. No. 4,112,870, the disclosure of which is incorporated herein by reference.

In the section of the apparatus here illustrated, an endless photoconductive belt 5 is conveyed via rollers 1, 2, 3 and 4 in the direction of the arrow so as to move past an upper, oppositely moving surface portion of a developing roller 6 which is rotated in the direction indicated. The rollers 3 and 4 serve to guide and position the belt 5 at a suitably small distance from the developing roller so that a developing zone or slot A of the desired depth is maintained between the belt and roller 6.

The photoconductive layer, and consequently any electrostatic latent image formed on this layer, is present on the side of the endless belt 5 that faces toward the developing roller. With the aid of magnetic forces, which for instance may originate from a permanent magnet (not shown) installed inside the developing roller, the developing roller 6 carries into the developing slot A a brush formed of the developer powder 9. This powder is composed of mixed toner particles and magnetic carrier particles.

The developer brush comes in contact with the photoconductive layer of the belt 5 in the slot A, and consequently, when a latent electrostatic image is present on this belt, the image is developed by attracting toner particles away from carrier particles of the brush. The developing roller 6 then transports the developer brush out of the developing slot and moves the brush past a toner concentration sensor and control device 7. From that location the brush powder is moved farther and falls into a trough 10 of a powder reservoir 11 in which powder from the roller 6 is mixed with other portions of a supply of developing powder before being reused on the roller 6.

The concentration sensor 7 comprises a housing 151 containing a light source 215 and two light-sensitive cell elements 214 and 232, which are connected with a control circuit for operation as described in the cited U.S. patent.

The concentration sensor 7 continually senses the content of toner particles in the developer powder of the brush passing the location where a light beam from the source 215 impringes upon the brush. The toner concentration is sensed by detecting the light reflectance from the developer brush to the cell 232, a light-responsive resistor, of the sensor. The extent of reflection of the light of the beam gives a measure of the toner concentration in the developer, except in the intervals when the brush passing the sensor has just been used for developing a latent electrostatic image and thus has had its toner content reduced by the delivery of toner particles to the image. At other times, as described more particularly in U.S. Pat. No. 4,112,870, the sensor and the related control circuit measure the toner concentration in the supply of developer powder, and as soon as the measured concentration falls below a predetermined value a signal is emitted which causes a toner supply device (not shown) to replenish the toner content of the developer powder in the reservoir 11. The toner particles and the carrier particles each have their own light-reflectivity so that the reflectance of the developer composed of both types of particles depends upon the proportion between toner particles and carrier particles in the mixture.

It has been found, however, that the reflectance of the developer brush not only depends upon the proportion between toner particles and carrier particles in the developer mixture but is also influenced by the quantity of developer present where the reflectance is being measured. In other words, the reflectance is also influenced by the thickness of the developer brush at the location where it passes through the light beam of the sensor 7. This in turn is related to the fact that the distance from the surface of the developer brush to the reflectance measuring cell 232 varies with the thickness of the brush. Objectionable fluctuations of toner concentration which have been observed in the use of the known toner control system have been found attributable to variations of the thickness of the developer brush at a location where the light beam of the concentration sensor impinges upon the brush.

The source and cause of the fluctuation problem having thus been identified, a remedy is provided according to the present invention by shaping the developer brush so that it will be kept at a substantially constant thickness at the loction where the brush passes the concentration sensor. In this way, a layer of developer powder of constant thickness, so at a definite constant distance from the reflectance responsive element of the sensor, is exposed to the light beam of the sensor whenever a measure of toner concentration is to be taken for controlling replenishment of the toner content of the developer mixture.

The shaping of the brush to constant thickness can be effected in a simple manner by a blade-like device positioned in the path of the brush at a location between the developing zone and the light beam of the concentration sensor, with a free edge of this device spaced from the surface of the developing roller by a distance somewhat less than the normal or average thickness of the developer brush moving away from the developing zone. Such a thickness regulating device is refered to herein, for brevity, as a "brush shaper".

A very suitable brush shaper is provided by fixing to the top of the sensor housing 151 a small stainless steel cap 8 that protrudes toward the developing roller 6 to a free edge 8*a* located at the required distance from the roller surface. Such a brush shaper appears to operate optimally in the use of developing apparatus of the type illustrated when the free edge 8*a* is spaced from the developing roller surface by a distance of about 0.5 to 0.6 mm—in other words, when the thickness of the developer brush at the place where its reflectance is sensed is kept substantially constant at about 0.5 to 0.6 mm.

The thickness regulating device, or brush shaper, is mounted between the developing slot A and the sensor device 7 at a location as close as practicable to the point where the developer brush passes the light beam of the sensor device. The thickness regulating device extends far enough into the developer brush, almost touching the surface of roller 6 yet leaving a narrow slot B between its edge 8*a* and that surface, so that an excess quantity of developer powder is always present ahead of the slot B and only a part of this powder can pass through the slot. Any powder tending to accumulate above a certain excess ahead of the device 8 may drop into trough 10 from both sides alongside of device 8, because this is less wide than the sensor housing 151.

Figure 3:
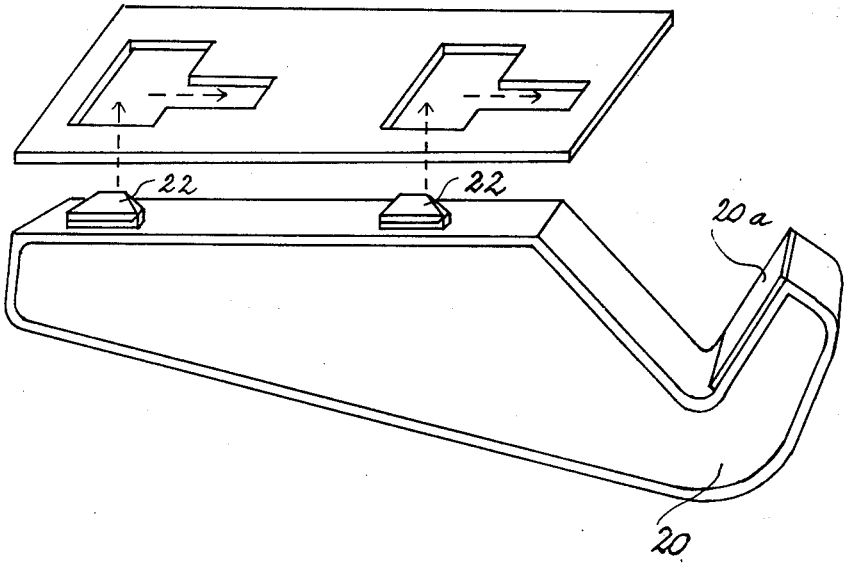
FIG. 3 is a perspective view of a reference surface element with a device for positioning it at the required location relative to the concentration sensor.

According to a further aspect of the invention, an auxiliary means is provided and utilized to advantage to aid proper adjustment of the concentration measuring and control system. In the illustrated embodiment, this auxiliary means comprises an element 20 (FIG. 3) which is provided with a reference surface 20*a* having a coefficient of reflection corresponding to that which a layer of developer powder of the prescribed thickness on roller 6 exhibits to the sensor device 7 when the developer has the desired toner concentration. For instance, the reference surface is made to have exactly the same reflection to the sensor as a 0.5 to 0.6 mm thick layer of developer of the desired concentration on the surface of roller 6. The reference surface consequently can be considered as a substitute for a developer of constant desired composition.

With the aid of, for instance, a clamping device 22 provided for this purpose, the reference surface element 20 can quickly be mounted in the developing apparatus and again removed. In mounted condition the reference surface 20*a* of the element is situated exactly at the location where otherwise the measuring head 7 "sees" the developer brush. The reflectance of the reference surface to the light-responsive element of the sensor then can be utilized as the basis for adjusting the concentration control circuit to a setting assuring its proper operation.

The advantages of so utilizing the reference surface are evident: since no developer is required to be present on the developing roller, the adjustment can be carried out in a quicker, easier and cleaner manner.

After an adjustment has been effected the reference surface can be used further for checking the performance of the measuring and control system as well as of the developer. When copy quality variations are observed, such as a paling of the copy or increasing background, it is simple to insert the reference element in place of the developer brush and then, by checking the response of the toner control system to the reference surface, to determine whether the quality variations are due to the developer or to erratic operation of the electronic components of the concentration control system, such as may be caused by a change of lamp voltage or of light intensity.

Instead of being used for checking only when copy quality variations are observed, the reference surface can also be part of a watch system in which the reference surface is placed automatically and periodically, for instance once per second or once every 10 minutes, in its reflecting position relative to the sensor beam and is then again removed. In this way both the toner concentration and the electronic components of the concentration control system are checked continually, and corrections can be made immediately after irregularities have been observed. Further, corrections may even be effected automatically.

We claim:

1. In a process for developing electrostatic images on a moving support, in which a magnetically formed brush of a two-component developer powder on a moving surface is transported by said surface through a developing zone between said surface and said support, said powder being a mixture of toner particles and carrier particles, and the concentration of toner particles in the brush is measured for controlling the toner content of the mixture by optically sensing the reflectance of the brush to a light beam at a location just beyond the developing zone, the improvement which comprises shaping said brush to a substantially constant layer thickness on said surface as the brush is being transported from the developing zone toward said location so that periodic optical sensings of said reflectance will be effected at a substantially constant distance from the brush.

2. A process according to claim 1, said shaping being effected by passing the brush through a slot formed between said surface and an edge of a thickness limiting element positioned near to said surface, said slot having a width less than the average layer thickness of said brush in the developing zone.

3. A process according to claim 1 or 2, and by said shaping keeping the layer of developer powder on said surface at a thickness of about 0.5 to 0.6 mm at said location.

4. A process according to claim 1; and for adjusting or checking the control of toner concentration placing in said location for and optically sensing the reflection of said light beam by, instead of said brush, a reference surface having the same reflectance value as that of a layer of said powder having said constant thickness and having the desired concentration of toner particles.

5. A process according to claim 1; and for adjusting or checking the control of toner concentration placing in said location for and optically sensing the reflection of said light beam by, instead of said brush, a reference surface having the same reflectance value as that of a 0.5 to 0.6 mm thick layer of said powder having the desired concentration of toner particles.

6. A process according to claim 4 or 5, and periodically repeating the placing of said reference surface in said location and keeping it there briefly in each placement for sensing its reflectance.

7. In apparatus for developing electrostatic images on a moving support, including a movable surface for transporting a magnetically formed brush of a two-component developer powder through a developing zone between said surface and said support, said powder being a mixture of toner particles and carrier particles, and means for measuring and controlling the content of toner particles in said mixture, said means including a sensor device for optically sensing the reflectance of said brush to a light beam at a location just beyond the developing zone, the improvement comprising means for shaping said brush to a substantially constant layer thickness on said surface as the brush is being transported from the developing zone toward said location so that periodic optical sensings of said reflectance will be effected at a substantially constant distance from the brush.

8. Apparatus according to claim 7, said brush shaping means comprising a thickness limiting element having an edge thereof positioned near to said surface between the developing zone and said location, said element forming between said edge and said surface a slot having a width less than the average thickness of said brush in the developing zone.

9. Apparatus according to claim 8, said slot having a width of about 0.5 to 0.6 mm whereby the brush passed through it to said location has a substantially constant thickness of about 0.5 to 0.6 mm.

10. Apparatus according to claim 8 or 9, said thickness limiting element being a stainless steel cap fixed to said sensor device.

11. Apparatus according to claim 7, 8 or 9, further comprising an auxiliary element that is positionable in said location to aid in adjusting or checking the control of toner concentration, said element presenting to said light beam a reference surface having the same reflectance value as that of a layer of said powder having said constant thickness and having the desired concentration of toner particles.

12. Apparatus according to claim 11, and means for periodically placing said auxiliary element in said location and removing it therefrom after a brief interval sufficient for sensing its reflectance.

* * * * *